US005937657A

United States Patent [19]

Benson et al.

[11] Patent Number: 5,937,657

[45] Date of Patent: Aug. 17, 1999

[54] COOLER

[75] Inventors: Trevor Paul Benson, Harvington; Nicholas James Baird, Brockworth, both of United Kingdom

[73] Assignee: Ultra Electronics Limited, Middlesex, United Kingdom

[21] Appl. No.: 08/913,716

[22] PCT Filed: Mar. 20, 1996

[86] PCT No.: PCT/GB96/00668

§ 371 Date: Sep. 22, 1997

§ 102(e) Date: Sep. 22, 1997

[87] PCT Pub. No.: WO96/29551

PCT Pub. Date: Sep. 26, 1996

[30] Foreign Application Priority Data

Mar. 23, 1995 [GB] United Kingdom ..... 9505915

[51] Int. Cl.[6] ..... F25B 19/02

[52] U.S. Cl. ..... 62/51.2; 62/216

[58] Field of Search ..... 62/51.2, 216

[56] References Cited

U.S. PATENT DOCUMENTS

| | | | |
|---|---|---|---|
| 3,823,575 | 7/1974 | Parel | 62/51.2 |
| 4,080,802 | 3/1978 | Annable | 62/51.2 |
| 4,126,017 | 11/1978 | Bytniewski et al. | 62/51.2 |
| 4,750,338 | 6/1988 | Hingst | 62/51.2 |
| 4,779,428 | 10/1988 | Chan et al. | 62/467 |
| 5,119,637 | 6/1992 | Bard et al. | 62/51.2 |

*Primary Examiner*—Ronald Capossela
*Attorney, Agent, or Firm*—Marshall, O'Toole, Gerstein, Murray & Borun

[57] ABSTRACT

A controller is provided for controlling the operation of a Joule-Thomson cooler. When the cooler has cooled down to its operating temperature, the rate of gas flow to the cooler is controlled as a function of the ambient temperature in order to maintain the gas flow at a minimum level.

15 Claims, 4 Drawing Sheets

COOLER

This invention relates to Joule Thomson coolers.

Joule Thomson coolers are devices that are used to provide point cooling to very low temperatures. Applications for these coolers include the cooling of superconducting materials. and the cooling of detector materials sensitive to infra-red radiation such as used in thermal imaging cameras and heat seeking missiles.

A Joule Thomson cooler, as shown in FIG. 1. comprises an expansion orifice 1 and a heat exchanger 2. High pressure gas, typically air. nitrogen or argon. is applied to the cooler inlet 3. When this gas passes through the expansion orifice, it expands to ambient pressure, which causes the temperature of the gas to drop. This gas, now at a temperature lower than that of the inlet gas, passes over the heat exchanger 2 before exiting the cooler at 4. The inlet as is therefore cooled in the heat exchanger by the expanded exiting gas. before reaching the expansion orifice 1, where further cooling occurs. A cumulative cooling effect takes place until the temperature drops to the point that the gas becomes liquid following expansion. The cooler is mounted within a vacuum encapsulation knows as a "dewar" 5, and a small pool of liquid 6 forms at the bottom of this dewar. Heat is extracted from the surrounding area as this liquid evaporates. The element 7 that requires cooling is also mounted within the dewar and is therefore cooled down to the boiling point of the working fluid The time taken for the formation of liquid gas in the cooler from the commencement of gas flow is referred to as "cooldown time", and is governed by the thermal mass of the equipment, the pressure of the inlet gas, the area of the expansion orifice (and hence, the mass flow rate of gas through the orifice), the thermodynamic properties of the gas, and the efficiency of the cooler.

Once liquid gas has been formed and cooldown is achieved, the cooler begins to operate in the steady state phase. At this time, the cooler only needs to consume sufficient gas to remove the steady state heat load from the cooled element and the surroundings. If the cooled element is an infra-red detector, the steady state heat load is made up of the electrical power dissipated in the detector element, the heat conducted across the wires to the detector element, the heat that radiates from the outer dewar wall onto the detector and inner dewar wall, and the heat that conducts down the inner dewar wall and cooler core from the "warm" end to the "cold" end.

The orifice area required to provide sufficient gas flow to absorb these heat loads is usually substantially less than that required to give a satisfactory cooldown time. The gas mass flow required to maintain the cooled element at the desired temperature is dependent upon the inlet pressure and ambient temperature, as shown in FIG. 2.

The simplest cooler construction would involve the use of a fixed expansion orifice, and the size of this orifice would be governed by the need to provide the required cooldown time, and to maintain cooldown at worst case conditions of maximum ambient temperature and minimum available inlet pressure. However, a fixed orifice gives a flow characteristic such that the flow rate increases during the cooldown phase as temperature falls, as shown in FIG. 4. The steady state flow rate is governed by the orifice area and the inlet gas pressure. A fixed orifice cooler will therefore be operating inefficiently for most of the time, because at any pressure and temperature other than the design point. the cooler will consume more gas than is required by the laws of thermodynamics to maintain cooldown.

The implications of inefficient operation depend on the source of high pressure gas for the cooler. If a rechargeable gas bottle is used. then the duration between bottle changing and recharging is much reduced. and if a compressor is supplying gas directly, then a larger flow capacity is required and any maintenance activities based on usage occur more frequently.

One known method of improving efficiency is to provide a means of changing the orifice area according to ambient conditions. This is achieved by introducing a regulating valve 8 into the orifice. as shown in FIG. 3. The valve 8 is adjustable by a bellows 9 which is connected to a probe 10 so as to sample the gas/liquid conditions downstream of the orifice 1 and valve 8. This orifice regulating mechanism is such as to allow a large orifice area to achieve a fast cooldown. and a reduced orifice area to give a flow rate that substantially matches the thermodynamic demands according to the inlet gas pressure and ambient temperature, as shown in FIG. 5. When set for minimum gas consumption. the steady state flow characteristic typically shows a fluctuation caused by hysteresis in the regulating mechanism that makes the valve oscillate between open and shut conditions.

Under very low temperature operating conditions. the high pressure gas supply to Joule Thomson coolers. must be of high purity. Contaminants such as water. carbon dioxide and hydrocarbons will solidify at temperatures equal to, or above, the boiling point of the working fluid, and if present in sufficient concentrations can form solid particles that block the expansion orifice and so restrict its area. Typically, the allowable concentrations of contaminants in a pure gas for Joule Thomson coolers are in the region of 1–2 parts per million.

Even when high purity gas is supplied to a self-regulating cooler, a gradual accumulation of contaminant particles may build up at the regulating valve. When this happens, the flow area is much reduced and so the gas flow rate falls. This causes the temperature to rise, and so the regulating valve opens and allows the contamination particles to pass through. The desired temperature is then restored and normal regulated operation continues until contamination accumulates again and the cycle is repeated.

A variety of materials is used for infra-red wavelength sensing, and these materials vary in cost, performance and sensitivity to operating temperature. Some applications use materials that are especially sensitive to temperature changes. Also. recent trends in the design of infra-red missile seekers and thermal imagers involve the use of large detector arrays with many elements either in a long linear or two dimensional square pattern. and temperature stability then becomes a more critical issue. Temperature fluctuations caused by the cooler regulating mechanism are, therefore, no longer acceptable.

In order to achieve the required degree of temperature stability, there are two practical options: first, either to use a self-regulating cooler set so that the regulating valve cannot close, but maintains a set minimum opening; or secondly, to use a cooler with a small fixed orifice and a regulated orifice in parallel. With both of these options, a minimum flow area is always available. This eliminates the temperature fluctuations described above. However, the disadvantage is that whilst the cooler behaves as a self-regulating type during cooldown and part of the steady state operating phase, at other times it behaves as a fixed orifice cooler and so is inefficient.

An object of the invention is to provide an improved Joule-Thomson cooler by controlling the input gas supply to the cooler.

This object is achieved according to the invention by controlling the pressure of the input gas supply to a Joule Thomson cooler in accordance with the ambient temperature so as to maintain the gas mass flow rate through the expansion orifice having a minimum orifice area at a minimum necessary for he prevailing ambient temperature.

With a self-regulating Joule Thomson cooler with a variable area expansion orifice and a predetermined minimum open orifice area, there is an optimum input gas pressure for any ambient temperature, at which the gas mass flow will be at a minimum level defined by the minimum open orifice area and the thermodynamic operating characteristic of desired gas mass flow against input gas pressure. Accordingly, the input gas pressure to the cooler is then regulated in accordance with the ambient temperature so that the gas mass flow is maintained as close as possible to said minimum level.

It will be appreciated that the minimum open orifice area may be provided by a regulating valve that does not close completely, or by providing a fixed orifice in parallel with an orifice that is fully regulated by a valve.

Also, the invention is applicable to Joule Thomson coolers with a fixed expansion orifice.

The input gas supply may be supplied by a compressor or a bottled gas supply.

The ambient temperature should be measured as close as possible to the detector, but may be measured close to the input gas supply, whether a compressor or bottled gas supply.

The invention will now be described by way of example with reference to the accompanying drawings in which.

Figure 2:
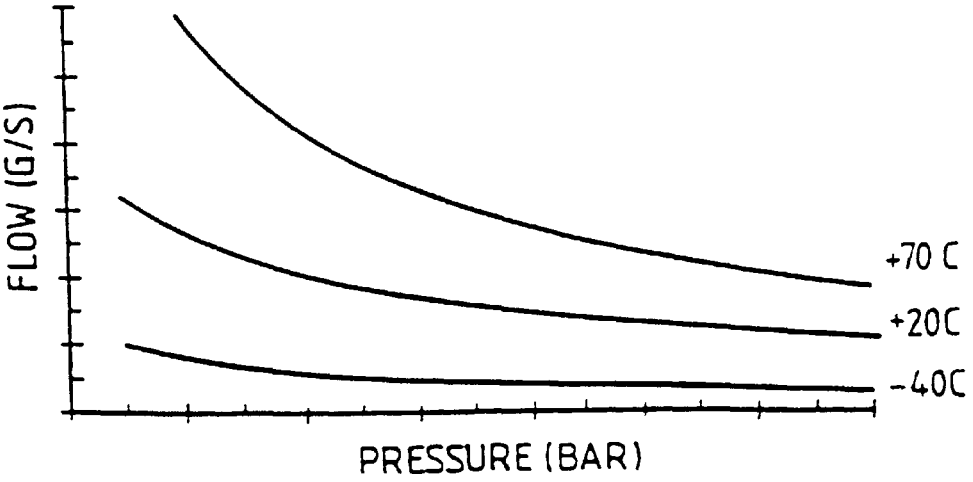
FIG. 2 is a graph showing the gas mass flow/input gas pressure required to maintain steady state conditions in the cooler of FIG. 1.
Figure 6:
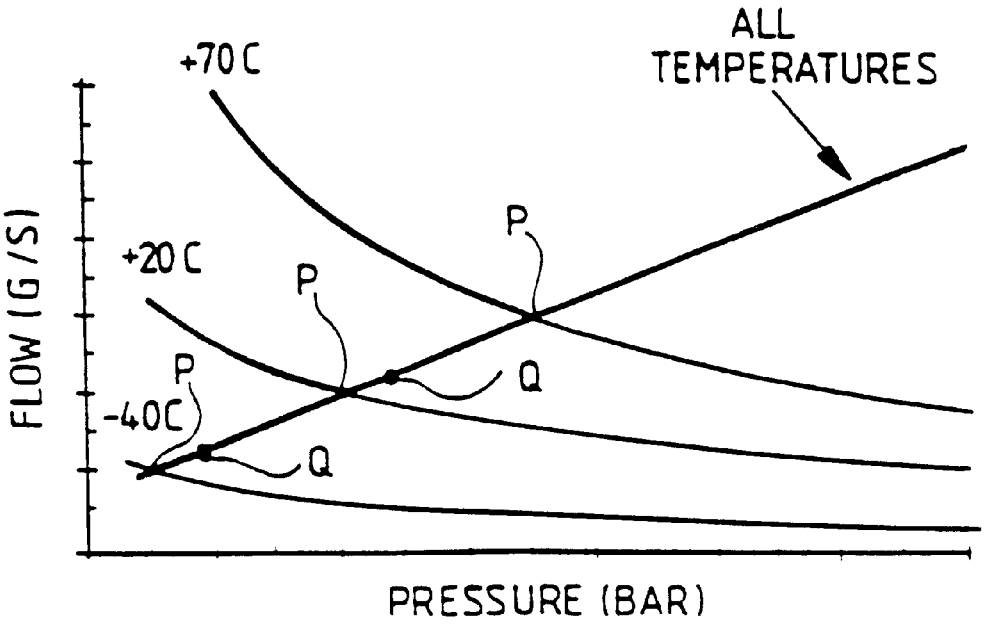
FIG. 6 is a graph showing the gas mass flow/input gas pressure characteristic for the cooler of FIG. 3 when further modified to have an expansion orifice with a minimum open area.

FIG. 6 shows the thermodynamic operating characteristic of desired gas mass flow/input gas pressure for a self-regulating Joule Thomson cooler with a predetermined minimum open orifice area. The characteristic is illustrated for each of three ambient temperatures of −40° C. +20° C. and +70° C. The optimum input gas pressure P on each characteristic curve occurs at the change-over point between the thermodynamic gas requirement (to the left-hand side of point P in FIG. 6), and the gas flow through the predetermined minimum orifice area (to the right-hand side of point P in FIG. 6). The curves on the left-hand side of the optimum points P correspond to the curves shown in FIG. 2, and the curves on the right-hand side of the optimum points P correspond to the expected linear characteristic of gas mass flow proportional to input gas pressure for a fixed orifice area.

Figure 7:
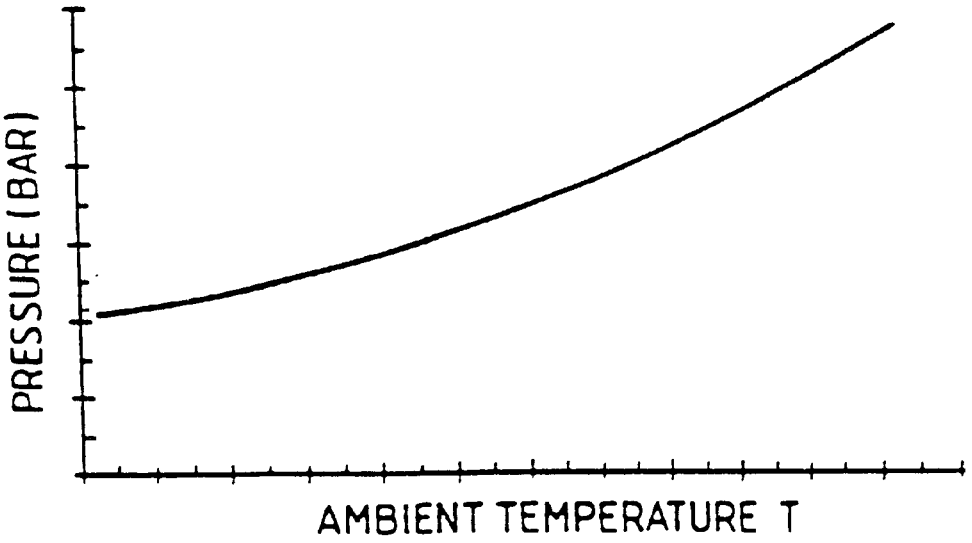
FIG. 7 is a graph showing the variation of optimum gas input pressure with ambient temperature T as represented in FIG. 6.

The relationship between the optimum input gas pressure at point P and the ambient temperature T is shown in FIG. 7. which demonstrates that this relationship is not a simple linear one. If the input gas pressure is therefore regulated in a simple linear manner according to ambient temperature. the cooler will not operate at maximum efficiency at all temperatures. For example, a simple linear control law set for optimum control at +70° C. would produce predicted optimum control points Q for operation at +20° C. and −40° C., as shown in FIG. 6. The preferred control law is therefore a non-linear control law such as:

$$P=aT^2+bT+c$$

or $$P=ae^{bt}$$

where a,b and c are constants. These laws would be set so as to give the best fit with the curve shown in FIG. 7. The above control laws are merely examples and other control laws could also be implemented.

Figure 1:
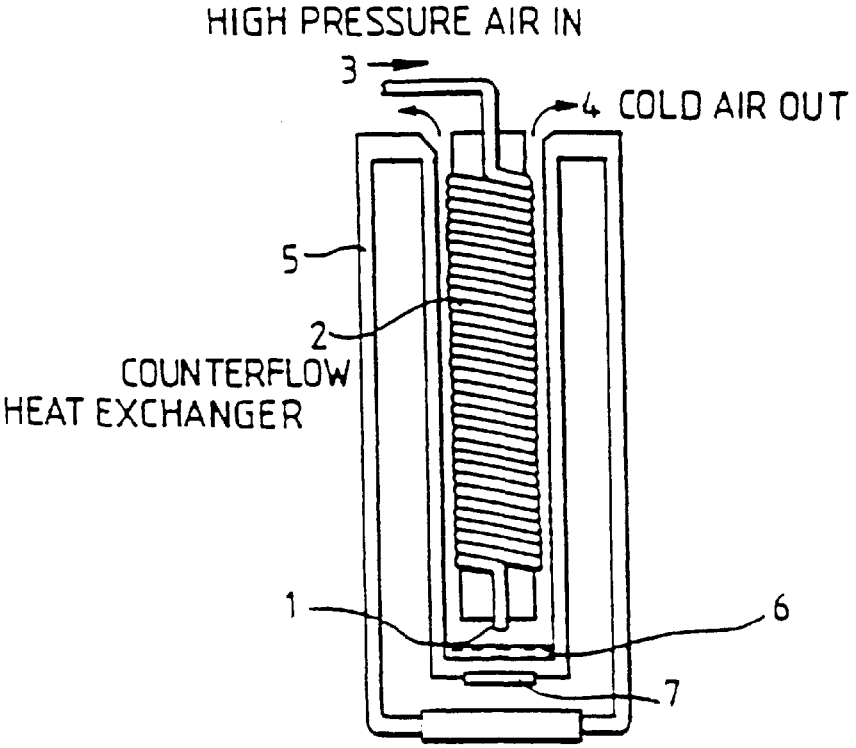
FIG. 1 is a schematic drawing of the Joule Thomson cooler.
Figure 3:
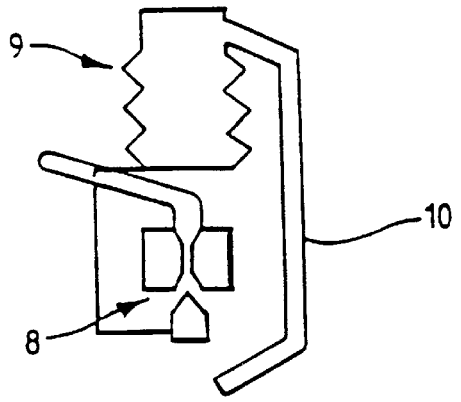
FIG. 3 is a schematic drawing of a modification to the cooler of FIG. 1 so that it is self-regulating.
Figure 4:
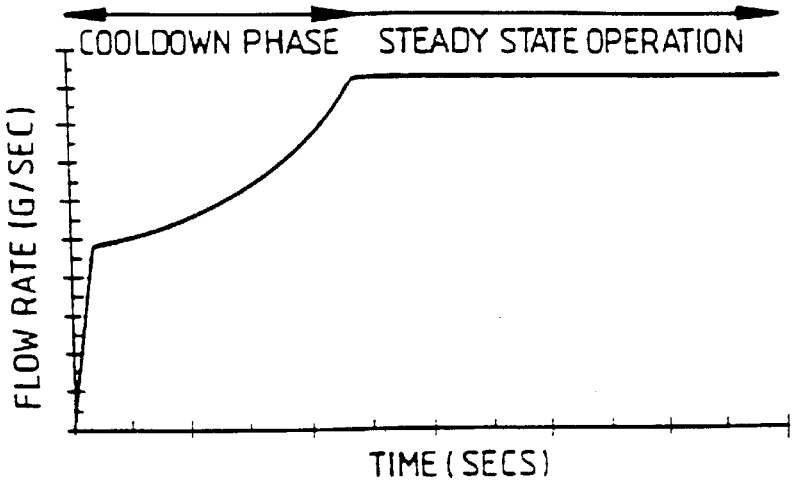
FIG. 4 is a graph showing the variation of gas mass flow with time for the cooler of FIG. 1 during cooldown and subsequent steady state conditions.
Figure 5:
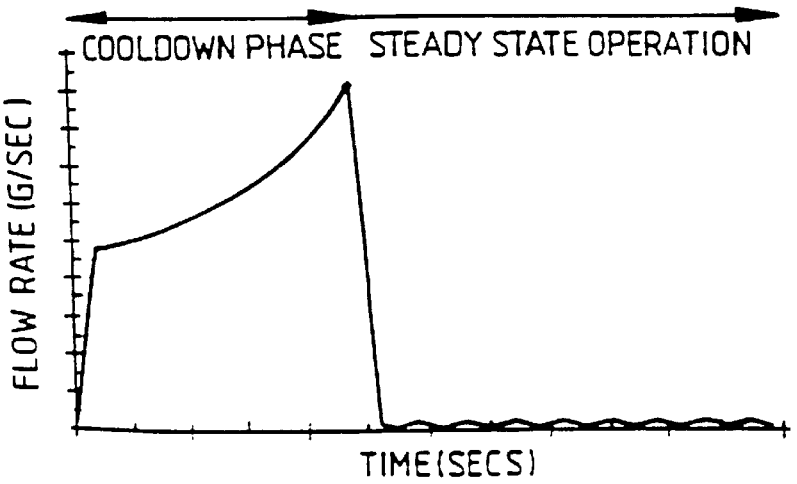
FIG. 5 is a graph showing the variation of gas mass flow with time for the modified cooler of FIG. 3.
Figure 8:
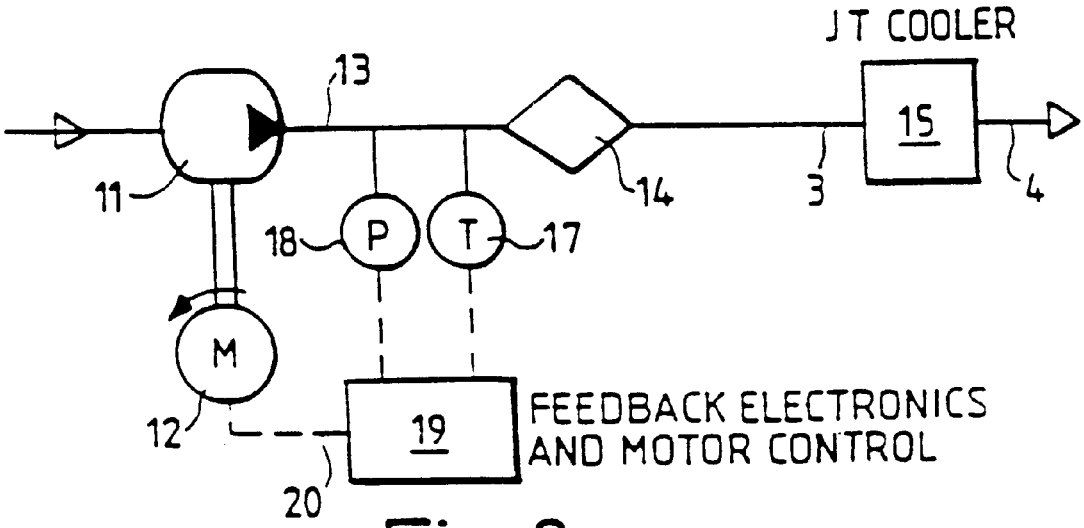
FIG. 8 is a schematic drawing of a Joule Thomson cooler with control system according to one embodiment of the invention.

FIG. 8 shows a control system used to control the input gas pressure to a cooler 15 from a compressor 11 driven by an electric motor 12. The output 13 from the compressor 11 is purified in a filter 14 and passed to the input 3 of a self-regulating cooler 15, which takes the form illustrated in FIG. 1 and 3, and has the valve 8 set so that it has a maximum closed position with a predetermined minimum area of the orifice 1 remaining open. Fluid exits from the cooler at 4.

A temperature sensor 17 and pressure sensor 18 are located in the output 13 from the compressor to sense the temperature and pressure of this gas, and the corresponding sensor signals are fed to an electrical controller 19. Ideally the ambient temperature measurement would be made as close as possible to the Joule-Thomson cooler. However, this may be difficult in practice. Placing the temperature sensor a small distance away, such as downstream of the compressor, enables a sufficiently accurate estimate of ambient temperature to be made. The controller 19 incorporates the required control law relating the cooler input gas pressure to the ambient temperature represented by the input gas temperature, and produces a corresponding output control signal 20 which controls the motor 12 so as to vary the speed of the compressor 11, and hence the input gas pressure at 3.

Figure 9:
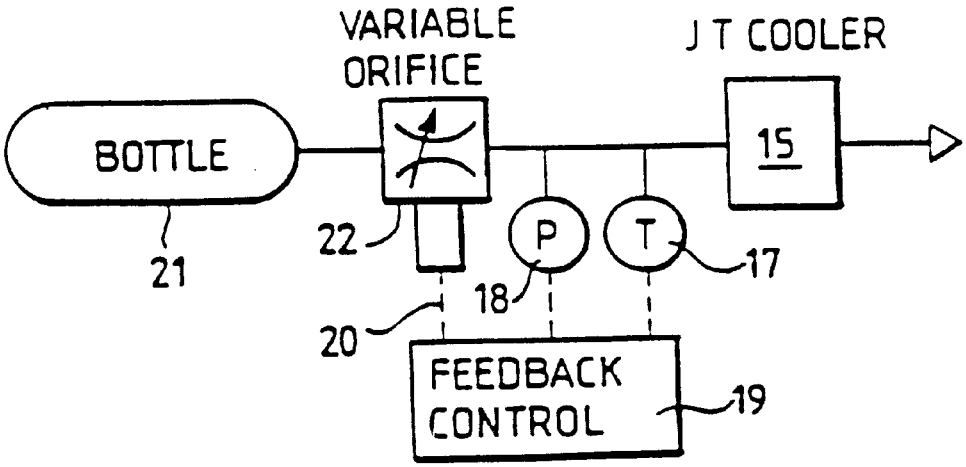
FIG. 9 is a schematic drawing of a Joule Thomson cooler with control system according to a second embodiment of the invention.

An alternative embodiment of the invention is illustrated in FIG. 9 as applied to a self-regulating cooler 15 supplied with compressed gas from a bottled gas supply 21. A variable orifice regulator 22 controls the pressure of the gas to the cooler 15 at input 3, and is in turn controlled by an electrical controller 19 in accordance with the temperature and pressure of the gas at input 3 as detected by sensors 17 and 18. The cooler 15 takes the form illustrated in FIGS. 1 and 2, and has a valve 8 set so that it has a maximum closed position with a predetermined minimum orifice area remaining open. The controller 19 incorporates the required control law relating the cooler input gas pressure to the input gas temperature, and produces a corresponding output control signal 20 to vary the orifice size of the regulator 22.

It will be appreciated that the valve 8 in both the illustrated systems of FIGS. 8 and 9 can be replaced by a valve which can close fully, but which is connected in parallel with a fixed orifice that allows a constant gas mass flow corresponding to the minimum orifice area of the valve 8 in the system of FIGS. 8 and 9.

We claim:

1. A control apparatus for a Joule-Thomson cooler, the cooler comprising an inlet and an expansion orifice and the control apparatus comprising a controller arranged to control the pressure of an input gas supply, as measured by a pressure sensor, to a Joule-Thomson cooler in accordance with the ambient temperature as measured by a temperature sensor so as to maintain the gas flow rate through the expansion orifice having a minimum orifice area at substantially a minimum necessary for the prevailing ambient temperature.

2. A control apparatus as claimed in claim 1, further comprising a temperature sensor for providing a measurement of ambient temperature to the controller.

3. A control apparatus as claimed in claim 2, in which the temperature sensor is arranged to measure the temperature of the input gas supply.

4. A control apparatus as claimed in claim 2, in which the temperature sensor is arranged to measure the ambient temperature surrounding the Joule-Thomson cooler.

5. A control apparatus as claimed in claim 1, further comprising a pressure sensor for providing a measurement of the input gas supply pressure to the controller.

6. A control apparatus as claimed in claim 1, in which the controller is arranged to control the input gas supply pressure such that the gas pressure increases monotonically in a non-linear fashion with increasing temperature.

7. A control apparatus as claimed in claim 1, in which the input gas supply pressure is derived according to the formula $$P=aT^2+bT+c$$

where P=input gas supply pressure, T=temperature, and a, b, and c are constants.

8. A control apparatus as claimed in claim 1, in which the input gas supply pressure is derived according to the formula $$P=ae^{bt}$$

where P=input gas supply pressure, T=temperature, and a and b are constants.

9. The control apparatus of claim 1, in combination with a Joule-Thomson cooling system comprising a Joule-Thomson cooler having an expansion orifice having a minimum area.

10. A Joule-Thomson cooling system as claimed in claim 9, further comprising a compressor for supplying the input gas supply to the expansion orifice of the cooler and in which the controller is a feedback controller arranged to control the compressor so as to set the input gas pressure to a desired value derived from the control apparatus.

11. A Joule-Thomson cooling system as claimed in claim 9, further comprising a variable orifice for controlling the gas supply to the expansion orifice of the cooler, and in which the controller is a feedback controller arranged to control the variable orifice so as to set the input gas pressure to a desired value derived from the control apparatus.

12. A Joule-Thomson cooler as claimed in claim 11, in which the input gas is supplied from a bottled gas supply.

13. A Joule-Thomson cooler as claimed in claim 9, in which the Joule-Thomson cooler has a fixed expansion orifice.

14. A Joule-Thomson cooler as claimed in claim 9, in which the Joule-Thomson cooler has a variable expansion orifice having a minimum open area.

15. A method of operating a Joule-Thomson cooler having an inlet and an expansion orifice having a minimum surface area, the method comprising the steps of supplying gas to the inlet of the Joule-Thomson cooler, measuring the pressure of the gas, measuring an ambient temperature, and controlling the pressure of the gas in accordance with the ambient temperature so as to maintain the gas mass flow rate at substantially the minimum necessary for the prevailing ambient temperature.

* * * * *